US006286290B1

(12) United States Patent
Fluck

(10) Patent No.: US 6,286,290 B1
(45) Date of Patent: Sep. 11, 2001

(54) CONVEYOR APPARATUS FOR DEPOSITING PRODUCTS IN GROUPS INTO CONTAINERS

(75) Inventor: René Fluck, Schleitheim (CH)

(73) Assignee: Sig Pack Systems AG, Beringen (CH)

( * ) Notice: Subject to any disclaimer, the term of this patent is extended or adjusted under 35 U.S.C. 154(b) by 0 days.

(21) Appl. No.: 09/293,032

(22) Filed: Apr. 20, 1999

(30) Foreign Application Priority Data

May 26, 1998 (CH) ..... 1156/98

(51) Int. Cl.[7] ..... B65B 1/04; B65B 5/06; B65B 57/10; B65G 47/31

(52) U.S. Cl. ..... 53/54; 53/244; 53/246; 53/247; 53/252; 53/498; 198/460.1

(58) Field of Search ..... 53/244, 246, 247, 53/252, 54, 498; 198/460.1, 461.1

(56) References Cited

U.S. PATENT DOCUMENTS

| | | | | |
|---|---|---|---|---|
| 2,324,930 | * | 7/1943 | Joa . | |
| 4,028,864 | * | 6/1977 | Bell . | |
| 4,577,453 | | 3/1986 | Hofeler . | |
| 4,768,642 | | 9/1988 | Hunter . | |
| 5,018,334 | * | 5/1991 | Guttinger et al. . | |
| 5,127,209 | | 7/1992 | Hunter . | |
| 5,768,856 | * | 6/1998 | Odenthal | 53/252 |

FOREIGN PATENT DOCUMENTS

| | | | |
|---|---|---|---|
| 28 14 686 | | 1/1984 | (DE) . |
| 3708604 | * | 9/1988 | (DE) . |
| 195 22 189 | | 8/1997 | (DE) . |
| 0 250 190 | * | 12/1987 | (EP) . |
| 0 353 800 | * | 2/1990 | (EP) . |
| 0 551 613 | * | 7/1993 | (EP) . |
| 0 594 917 | | 5/1994 | (EP) . |
| 1393472 | | 2/1965 | (FR) . |
| 5-278840 | | 10/1993 | (JP) . |
| 96/41760 | | 12/1996 | (WO) . |
| 97/42108 | | 11/1997 | (WO) . |

* cited by examiner

*Primary Examiner*—S. Thomas Hughes
*Assistant Examiner*—Eric Compton
(74) *Attorney, Agent, or Firm*—Venable; Gabor J. Kelemen

(57) ABSTRACT

A conveyor apparatus includes first and second conveyors for moving products from a receiving station to a first transfer station and a plurality of product-carrying elements mounted on the conveyors. The product-carrying elements of the first and second conveyors form respective first and second groups of product-carrying elements. The products are conveyable from the receiving station to the first transfer station alternatingly by the two conveyors. A first discharge mechanism at the first transfer station includes a plurality of product-pushing elements for displacing products transversely to the advancing direction. The product-pushing elements are spaced identically to the spacing of the product-carrying elements. A third conveyor extends from the first transfer station to a second transfer station. Receiving elements are mounted on the third conveyor for carrying containers from the first transfer station, where products are placed into the containers by the product-pushing elements, to the second transfer station.

13 Claims, 5 Drawing Sheets

CONVEYOR APPARATUS FOR DEPOSITING PRODUCTS IN GROUPS INTO CONTAINERS

CROSS REFERENCE TO RELATED APPLICATION

This application claims the priority of Swiss Application No. 1156/98 filed May 26, 1998, which is incorporated herein by reference.

BACKGROUND OF THE INVENTION

International Application WO 96/41760 describes an apparatus for conveying products to a packing machine. The apparatus has two parallel, separately driven endless conveyor chains which carry, along less than one half of their circumferential lengths, carrier elements arranged at uniform distances from one another and extending from the respective chains. The carrier elements advance the products on a slotted slide plate from a receiving station through a work section to a discharge station where the products are packed in a tubular bag.

International Application WO 97/42108 describes a similar apparatus in which the two parallel conveyor elements are toothed belts.

U.S. Pat. No. 4,577,453 describes a conveyor apparatus which has but a single conveying element and wherein the products are, at the transfer station, first pushed in groups onto a table and are thereafter deposited by separate pushers into a packing container perpendicularly to the discharging direction.

SUMMARY OF THE INVENTION

It is an object of the invention to provide an improved conveyor apparatus of the above-outlined type with which packing containers may be charged with products in a rational manner.

This object and others to become apparent as the specification progresses, are accomplished by the invention, according to which, briefly stated, the conveyor apparatus includes first and second parallel-spaced endless conveyors extending from a receiving station to a first transfer station for moving products in an advancing direction from the receiving station to the first transfer station and a plurality of product-carrying elements mounted on the first and second conveyors at a uniform spacing from one another. The product-carrying elements mounted on the first conveyor form a first group of product-carrying elements and the product-carrying elements mounted on the second conveyor form a second group of product-carrying elements. The first and second groups extend over one part of the length of the respective first and second conveyors. A drive moves the first and second conveyors independently from one another such that products are conveyable from the receiving station to the first transfer station alternatingly by the first and second conveyors. A discharge mechanism, situated at the first transfer station, includes a plurality of product-pushing elements for displacing products transversely to the advancing direction away from the product-carrying elements. The product-pushing elements are spaced identically to the spacing of the product-carrying elements. A third conveyor extends from the first transfer station to a second transfer station. Receiving elements are mounted on the third conveyor for carrying containers from the first transfer station, where products are placed into the containers by the product-pushing elements, to the second transfer station

DESCRIPTION OF THE PREFERRED EMBODIMENTS

Figure 1:
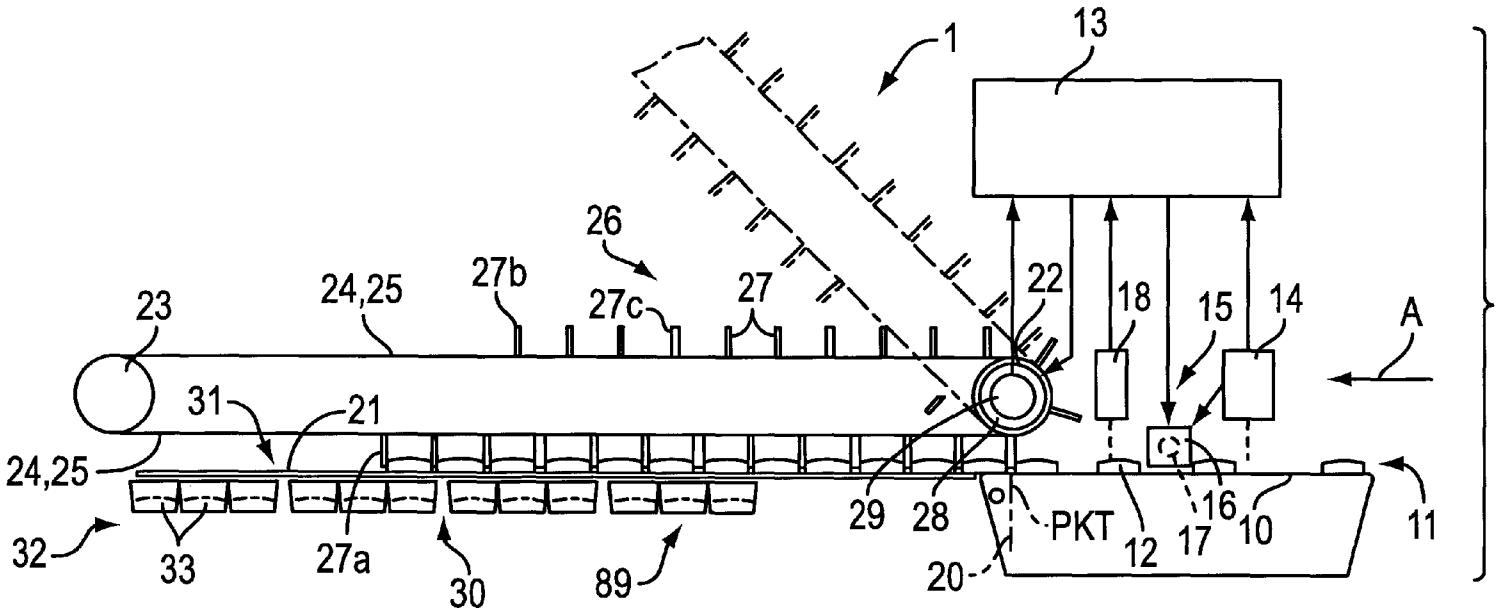
FIGS. 1 and 2 are schematic side elevational views of a preferred embodiment of the invention.
Figure 2:
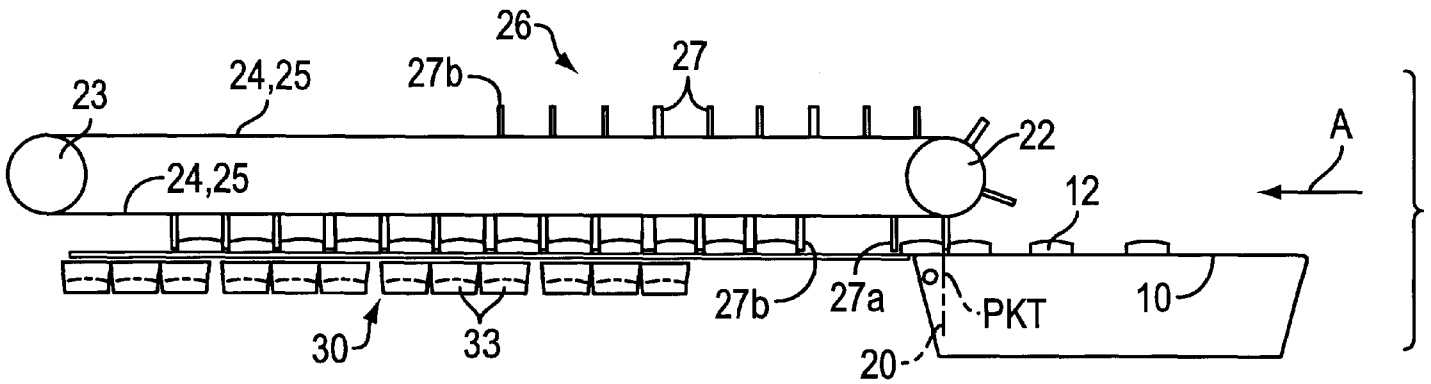

Turning to FIGS. 1 and 2, a supply belt 10 is arranged upstream of a conveyor apparatus 1 as viewed in the direction A in which wafer-like products 12 (such as biscuits) are advanced in a column 11. The products 12 may be spaced at random from one another. While the conveyor belt 10 is driven to preferably run at constant speed, in case it runs at variable speed, its drive motor is connected with an angular position transmitter which, in turn, is connected with a control device 13 of the apparatus 1. Above the conveyor belt 10 a product sensor 14 is disposed which measures the dimensions and shape of the product 12 passing thereunder and compares the sensed magnitudes with inputted and/or learned desired values. Such a measuring step determines not only the outer shape (footprint) of the product 12 and its length on the conveyor belt 10, but also the upper face thereof. In case the deviations from the desired product configuration exceed predetermined tolerances, a signal is directly applied to an ejection unit 15 which pushes the respective product 12 downstream of the sensor 14 in a direction transverse to the conveying direction A from the conveyor belt 10 into a non-illustrated receptacle. The ejection unit 15 may include a pusher 16 which is briefly operated by an actuator 17 or may include a nozzle which emits a short air blast to remove the defective product 12. Downstream of the ejection unit 15 and immediately upstream of a receiving station 20 of the apparatus 1 a further sensor 18 is arranged which may be an optical barrier operating with reflected light and which, by means of the control unit 13, ensures an accurate, cycled introduction of the products 12 into the apparatus 1 at the receiving station 20.

The apparatus 1 includes a sheet metal slide 21 and two endless, parallel toothed belts 24, 25 supported on end sprockets 22, 23 and positioned above the slide 21. A group 26 of uniformly spaced product-carrying elements 27 extends from each belt 24, 25. The group length is shorter than one-half of the circumferential length of each belt 24, 25. The two sprockets 22 situated at the receiving station 20 are driven by separate motors 28 each having an angular displacement sensor 29. The motors 28 are controlled by the control apparatus 13 in such a manner that in each instance one product-carrying element 27 arrives immediately in front of a product 12 at the receiving station 20 and a successive, second product-carrying element 27 of the same group 26 arrives immediately behind the product 12, and such second product-carrying element 27 advances the product 12 on the slide 21. The motors 28 are controlled in such a manner that at the receiving station 20 in each instance the leading product-carrying element 27*a* of one group 26 adjoins the trailing product-carrying element 27*b* of the other group 26 immediately without an intermediate space as shown in FIG. 1. The control of the motors 28 may be effected, for example, as described in the earlier-noted International Application WO 96/41760. As soon as the trailing product-carrying element 27*b* of one group 26 engages a product 12 (FIG. 1), the corresponding belt 25 is accelerated (FIG. 2) until the group 26 is aligned on the horizontal work portion 31 with the groups 32 of packing containers 33 which are disposed at a transfer station 30 laterally of the slide 21 and parallel thereto. When such an alignment is reached, the belt 25 is stopped and the products 12 of the entire group 26 are simultaneously laterally pushed into the containers 33 by a mechanism to be described later. For maintenance work, the two toothed belts 24, 25 may be individually or together pivoted about the axis of the sprocket wheels 22 as illustrated in phantom lines in FIG. 1. If a pivotal motion about the downstream end sprockets 23 is preferred, then expediently it is the end sprockets 23 which are driven by the motors 28.

Figure 3:
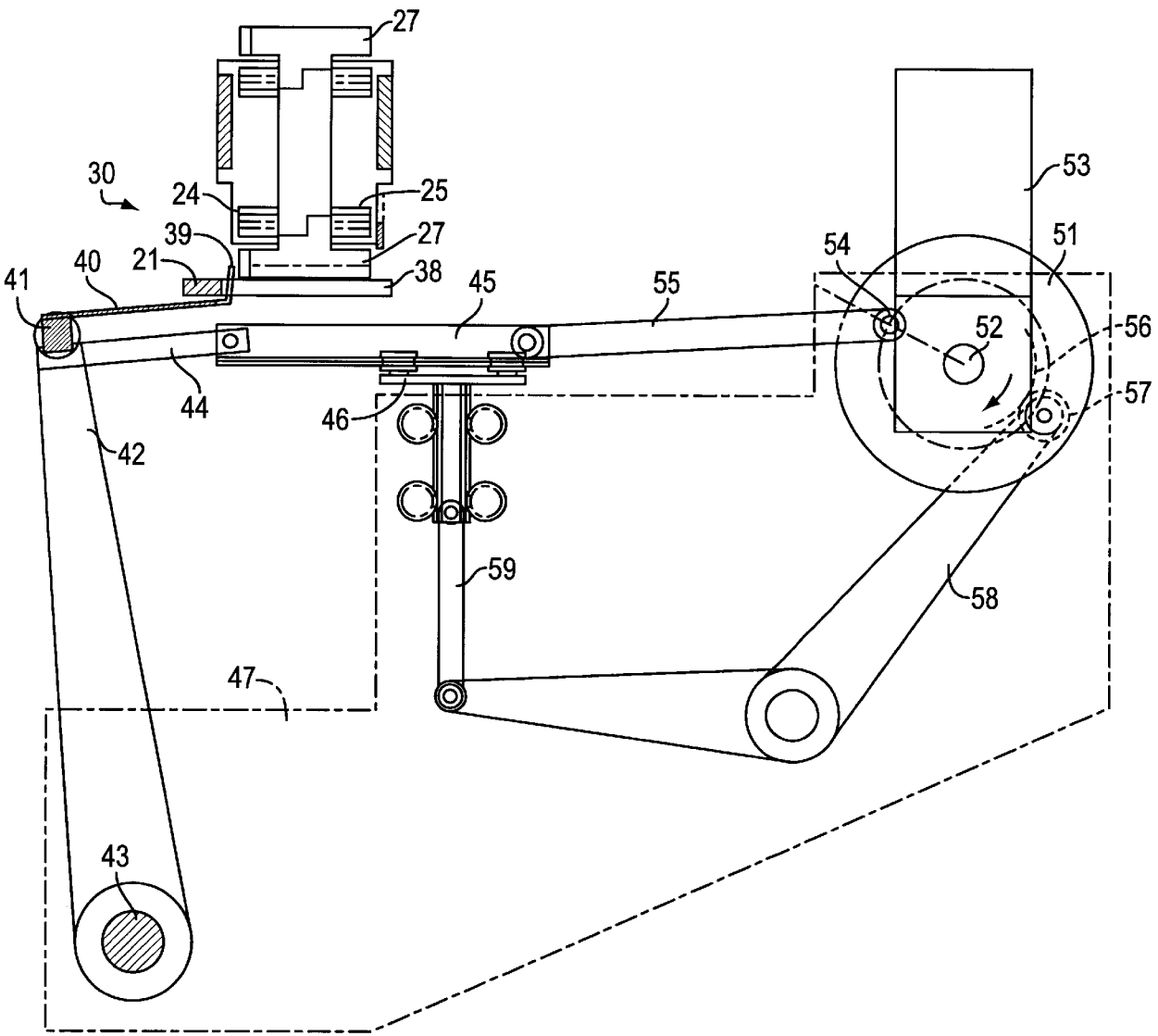
FIG. 3 is a schematic end elevational view of a transverse product-discharging device forming part of the preferred embodiment.

FIG. 3 schematically illustrates an exemplary mechanism for pushing out the products 12 at the transfer station 30. The slide 21 has, at the transfer station 30, a series of transverse slots 38 spaced identically to the spacing of the product-carrying elements 27; in any case, two slots 38 are provided for every intermediate space between adjoining product-carrying elements 27. An upwardly bent end 39 of a pusher 40 projects through each of the slots 38. The pushers 40 are affixed to a joint bar 41 which is swingably supported at its opposite ends by two pivotal levers 42. The two levers 42 are connected rigidly to one another by a joint shaft 43 which extends parallel to the conveying direction A. The levers 42 are pivotal about the axis of the shaft 43. The bar 41 is rigidly connected with one end of a lever 44 whose other end is jointed to a carriage 45. The carriage 45 is horizontally shiftably guided on a carriage support 46 which, in turn, is vertically displaceably guided in a housing 47 of the conveyor apparatus 1. A disk 51 is connected with a shaft 52 which extends parallel to the shaft 43. During the ejecting motion, a motor 53 rotates the shaft 52 in each instance through one revolution. On the disk 51, on one side thereof, an eccentric pin 54 is mounted which is coupled with the carriage 45 by means of a link rod 55. On the opposite side of the disk 51 a cam disk 56 is mounted which, by means of a follower roller 57, a pivotal two-arm lever 58 and a linkage rod 59, causes the vertical motion of the carriage support 46. During the ejection motion, the corresponding belt 25 is at a standstill and the carriage support 46 is in its shown raised position, so that the upwardly bent end 39 of the pushers 40 displaces the column of the products 12 within the group 26 from the product-carrying elements 27 transversely to the conveying direction A into the containers 33 (not shown in FIG. 3). The elements 44, 45 and 46 as well as 55–59 are offset in the axial direction of the shaft 53 in such a manner that the containers 33 have sufficient space adjacent the slide 21. For executing a return stroke, the carriage support 46 is lowered by means of the cam disk 56 and the lever 58 so that as early as the duration of such a return stroke, the product-carrying elements 27 of one group 26 may be moved away by means of the belt 25 from the region of the transfer station 30. During the ejection of the products 12 at the transfer station 30, the products 12 are, at the receiving station 20, introduced between the product-carrying elements 27 of the second group 26 of the then advancing other belt 24. The ejecting operation is repeated thereafter for the second group 26.

Figure 3A:
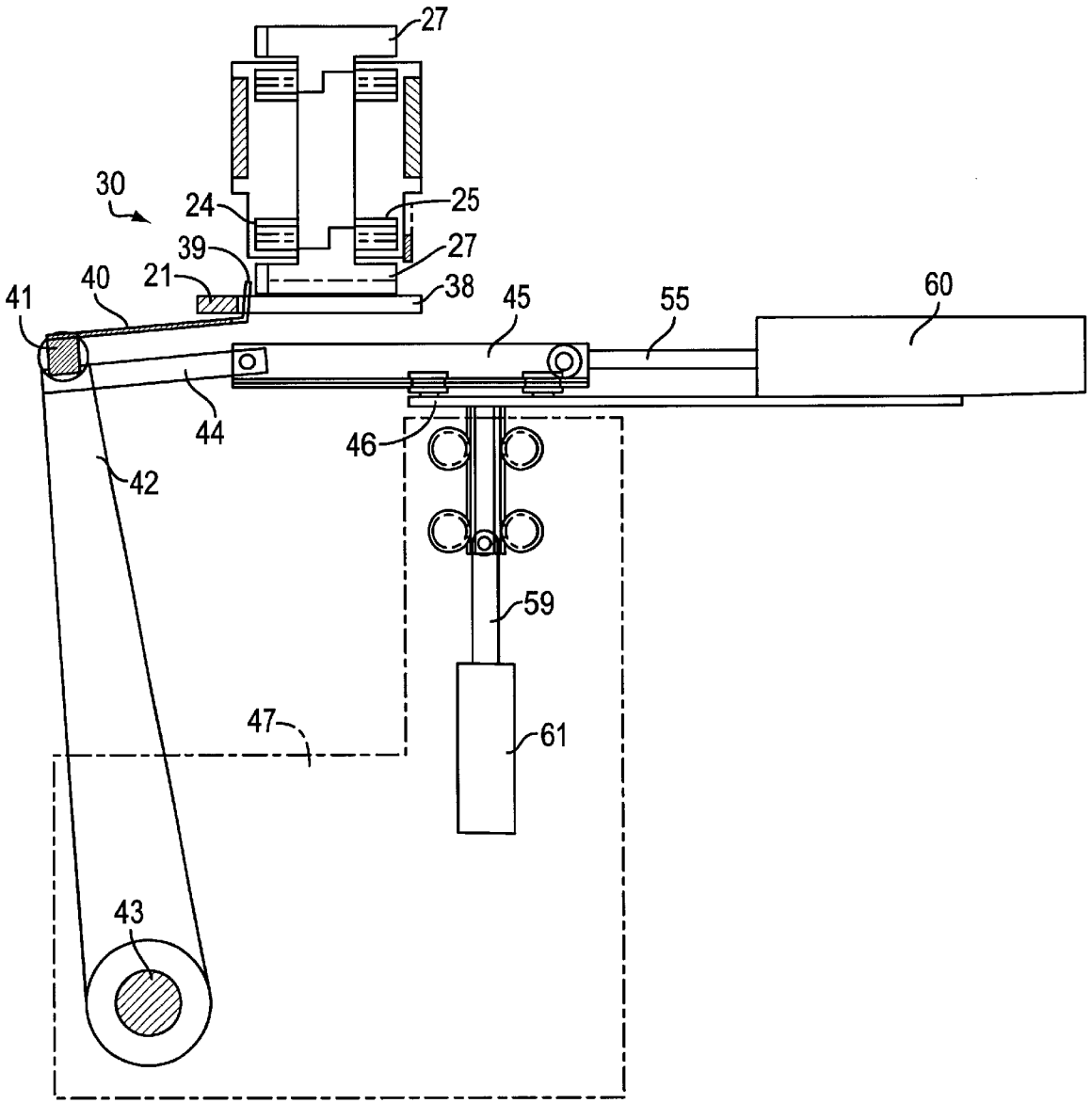
FIG. 3*a* is a schematic end elevational view of a transverse product-discharging device according to a variant of the FIG. 3 construction.

Instead of the above-described crank and cam disk drive shown in FIG. 3, it is feasible to operate the carriage support 46 and the carriage 45 by linear motors 60, 61 as shown in FIG. 3*a*.

Figure 4:
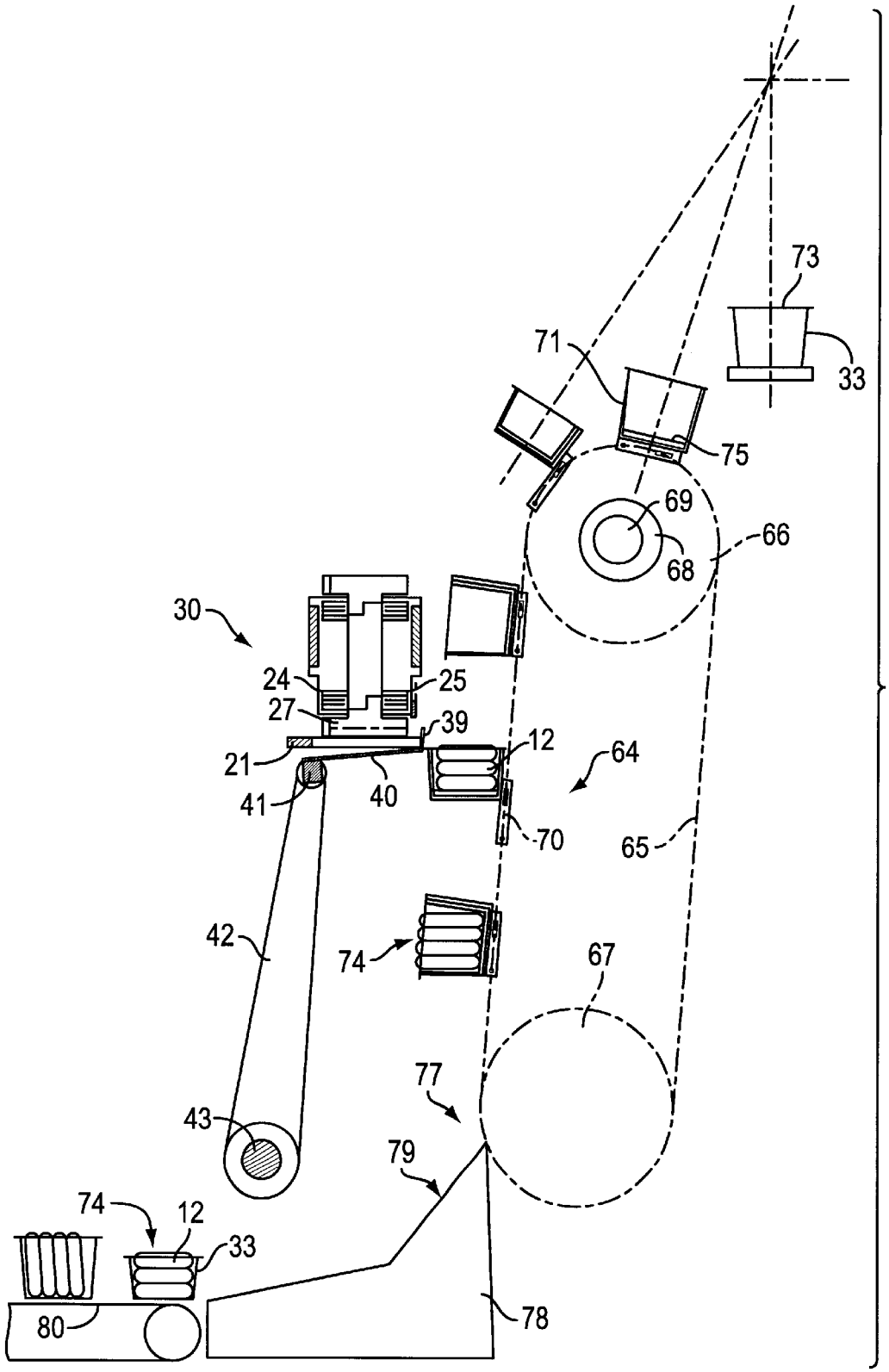
FIG. 4 is a schematic end elevational view of a container-positioning and discharging device-forming part of the preferred embodiment.

FIG. 4 illustrates the transfer station 30 without the elements 44–59 (which are axially offset). At the transfer station 30 on that side of the slide 21 which is oriented away from the pushers 40, a conveyor member 64 is arranged which is formed of two parallel endless chains 65, each supported by two end sprockets 66, 67. The two end sprockets 66 and the two end sprockets 67 form respective coaxial sprocket pairs. The sprocket pair composed of the sprockets 66 is driven by a motor 68 having an angular displacement sensor 69. The motor 68 and the sensor 69 are connected to the control device 13. Carriers 70 are mounted on the chains 65 and extend uniformly spaced therebetween. Receiving elements 71 for accommodating the packaging containers (trays) 33 are selectively secured to the carriers 70 such that the open end 73 of the containers 33 is oriented at the transfer station 30 approximately horizontally or vertically. In FIG. 4, for purposes of illustration, the receiving elements 71 are shown alternatingly in these two positions. In reality, all receiving elements 71 of the conveyor member 64 are mounted only in the one or in the other orientation. In a first case the groups 74 of products 12 are formed in the containers 33 in such a manner that the edge of each product 12 of the formed groups 74 touches the bottom 75 of the container 33. In a second case, the flat large surface of one product lies on the container bottom 75. In the first case, after each ejecting process, the chains 65 are incrementally moved forward one step corresponding to the thickness of the products 12 until the respective containers 33 are filled. Thereafter, a feeding step follows, corresponding to the division of the carrier 70 less the thickness of the groups 74. In the second case, the chains 65 are advanced in such a manner that the opening 73 at the transfer station 30 in each instance arrives just underneath the upper side of the slide 21. As soon as the respective container 33 is filled, a feeding step takes place which corresponds to the length of the division (spacing) of the carriers 70.

At the lower sprockets 67 the containers 33 are caught at a transfer station 77 by a group of fingers 78 which project through non-illustrated slots provided in the receiving elements 71. The filled containers 33 slide on the sloping upper face 79 of the fingers 78 onto a removal conveyor belt 80. At the upper sprockets 66 the empty containers 33 are introduced into the receiving elements 71 by means of known, non-illustrated means.

Figure 5:
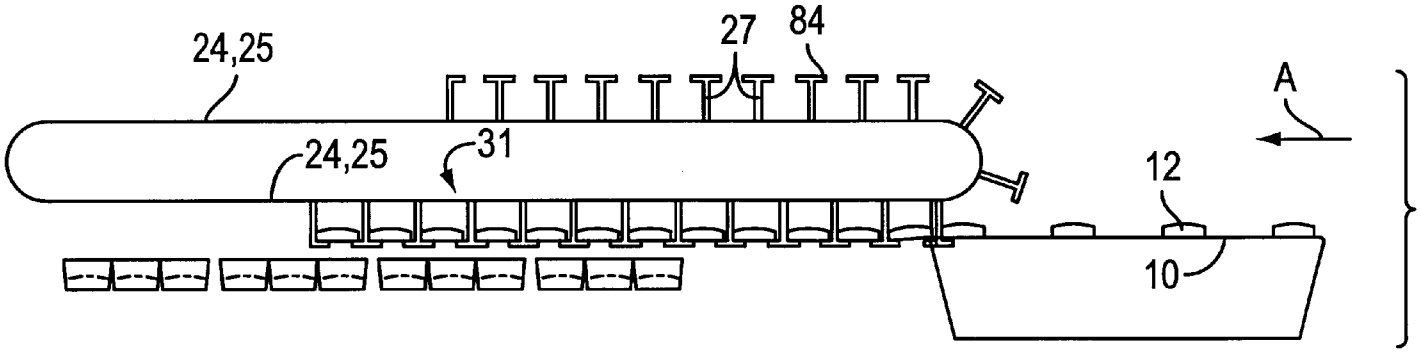
FIG. 5 is a schematic side elevational view of a further preferred embodiment of the invention.
Figure 7:
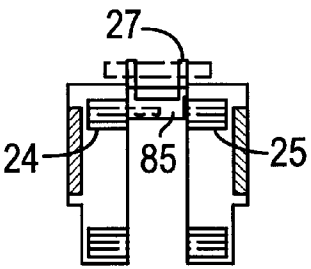
FIG. 7 is a schematic side elevation of the structure shown in FIG. 6.
Figure 6:
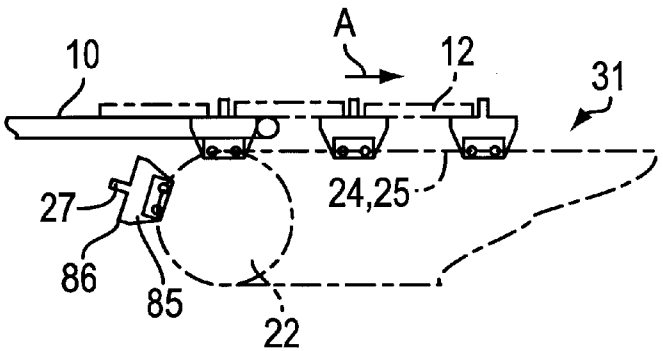
FIG. 6 is a schematic sectional end elevation of yet another preferred embodiment of the invention.

FIG. 5 illustrates a further embodiment according to which the product-carrying elements 27 are T-shaped as viewed laterally; that is, at their free ends horizontal product-supporting elements 84 extend which fully carry the products 12 from the receiving station 20 to the transfer station 30 and therefore the slide 21 is dispensed with. FIGS. 6 and 7 show a further variant in which the toothed belts 24, 25 or the conveyor chains are situated underneath the working section 31. The product-carrying elements 27 are mounted on carrier bodies 85; one group 26 of carrier bodies 85 is secured to the belt 24, while the other group 26 of carrier bodies 85 is secured to the belt 25. The carrier bodies 85 have product supporting surfaces 86 on either side of the product-carrying elements 27 (with the exception of the two ends of the groups 26).

A great extent of flexibility may be achieved with the apparatus according to the invention. The products 12 may be placed into the containers 33 selectively in an edgewise or in a flatly stacked orientation. A modular construction of the apparatus 1 is feasible. The filling of groups 74 into the containers 33 requires only a few steps resulting in a gentle handling of the products 12. A large output rate of up to 800 pieces per minute may be achieved. A series of packing containers 33 may be simultaneously charged with products. In FIGS. 1, 2 and 5 the containers to be charged with the products are shown as four side-by-side arranged container groups 89, wherein each group 89 is composed of three interconnected containers 33. The distance between adjoining containers belonging to different groups 89 is somewhat greater than the container distance within one and the same group 89. Accordingly, the pusher groups 26 too, are subdivided by the product-carrying elements 27 into three subgroups which are separated from one another by correspondingly thicker product-carrying elements 27*c*. These periodically non-uniform intervals between the product-carrying elements 27 are programmed in the control device 13, so that with signals from the sensor 18, an angular sensor relating to the drive of the belt 10 and an angular sensor 29, a cycling of the products 12 between the product-carrying elements 27 is effected in an accurate manner. Thus, in case of a supply rate of the products 12 on the belt 10 of approximately 720 pieces per minute, the clock frequency of the ejection step is 1 Hz. In case of longer group 32 of containers 33 and a longer work section 31 the clock frequency may be further reduced.

It will be understood that the above description of the present invention is susceptible to various modifications, changes and adaptations, and the same are intended to be comprehended within the meaning and range of equivalents of the appended claims.

What is claimed is:

1. A conveyor apparatus for advancing generally flat products and depositing the products in groups into containers each having an open side, comprising (a) first and second parallel-spaced endless conveyors extending from a receiving station to a first transfer station for moving products in an advancing direction from the receiving station to the first transfer station;

(b) a plurality of product-carrying elements mounted on the first and second conveyors at a uniform spacing from one another; said product-carrying elements mounted on said first conveyor forming a first group of product-carrying elements; said product-carrying elements mounted on said second conveyor forming a second group of product-carrying elements; said first and second groups extending over one part of a length of respective said first and second conveyors;

(c) drive means for moving said first and second conveyors independently from one another such that products are conveyable from said receiving station to said first transfer station alternatingly by said first and said second conveyors;

(d) a discharge mechanism situated at said first transfer station and including (1) a plurality of product-pushing elements for displacing products transversely to said advancing direction away from said product-carrying elements; said product-pushing elements being spaced identically to the spacing of said product-carrying elements mounted on said first and second conveyors; and (2) control means for moving said product-pushing elements;

(e) a third conveyor extending from said first transfer station to a second transfer station;

(f) receiving elements mounted on said third conveyor for carrying containers from said first transfer station, where products are placed into the containers through the open side thereof by said product-pushing elements, to said second transfer station; and (g) means for selectively mounting the containers on said receiving elements for selectively orienting the container opening horizontally or vertically, whereby the containers are selectively charged with the flat products in an edge-wise standing or in a flatly lying stack.

2. The conveyor apparatus as defined in claim 1, further comprising means for removing containers from said third conveyor.

3. The conveyor apparatus as defined in claim 1, wherein said product-carrying elements include means for supporting the products from below.

4. The conveyor apparatus as defined in claim 1, further comprising a product-supporting slide extending between said receiving station and said first transfer station; and wherein said product-carrying elements include means for pushing the products on and along said slide.

5. The conveyor apparatus as defined in claim 1, wherein said first and second conveyors have opposite ends; further comprising means for individually pivoting said first and second conveyors about an axis at one of the ends of said first and second conveyors.

6. The conveyor apparatus as defined in claim 1, wherein said first and second conveyors have opposite ends; further comprising means for together pivoting said first and second conveyors about an axis at one of the ends of said first and second conveyors.

7. The conveyor apparatus as defined in claim 1, further comprising (h) a control device connected to said drive means; and (i) a sensor connected to said control device for sensing a passage of a product and for applying sensor signals to said control device for cycling the products to said first and second conveyors as a function of said signals; said sensor being arranged upstream of said receiving station as viewed in said advancing direction.

8. The conveyor apparatus as defined in claim 1, further comprising (h) a control device connected to said drive means; and (i) a sensor connected to said control device for a quality-monitoring of the products passing by the sensor and for applying sensor signals to said control device; said sensor being arranged upstream of said receiving station as viewed in said advancing direction.

9. The conveyor apparatus as defined in claim 8, further comprising a product-ejecting device for removing defective products as a function of said signals.

10. The conveyor apparatus as defined in claim 1, wherein said third conveyor comprises an endless circulating conveyor carrying said receiving elements.

11. The conveyor apparatus as defined in claim 1, wherein said third conveyor comprises two parallel-spaced endless circulating conveyors carrying said receiving elements.

12. The conveyor apparatus as defined in claim 11, wherein said receiving elements are arranged in series extending parallel to said advancing direction of the products between said receiving station and said first transfer station.

13. The conveyor apparatus as defined in claim 1, wherein said control means of said discharge mechanism includes linear motors for driving said product-pushing elements.

* * * * *